US005441172A

United States Patent [19]

Yu

[11] Patent Number: 5,441,172

[45] Date of Patent: Aug. 15, 1995

[54] APPARATUS FOR DISPENSING THE CONTENT OF A COLLAPSIBLE PASTE TUBE

[76] Inventor: Abraham Yu, No. 24, Kung Ying Wu Street, Tainan City, Taiwan

[21] Appl. No.: 273,974

[22] Filed: Jul. 12, 1994

[51] Int. Cl.[6] ..... B65D 35/28; B65D 35/54

[52] U.S. Cl. ..... 222/52; 222/96; 222/102

[58] Field of Search ..... 222/52, 63, 95, 96, 222/102, 105, 333, 504

[56] References Cited

U.S. PATENT DOCUMENTS

| | | | |
|---|---|---|---|
| 2,064,357 | 12/1936 | Ritterbusch | 222/96 X |
| 3,151,616 | 10/1964 | Selfon | 222/102 X |
| 3,738,533 | 6/1973 | Bertrand | 222/102 |
| 3,860,147 | 1/1975 | Vessio et al. | 222/96 |
| 4,234,104 | 11/1980 | Apuzzo, Jr. et al. | 222/96 X |
| 4,258,864 | 3/1981 | Karamanolis et al. | 222/96 |
| 4,418,840 | 12/1983 | Gardner, Sr. | 222/102 X |
| 5,050,773 | 9/1991 | Choi | 222/102 X |
| 5,215,218 | 6/1993 | Choi | 222/63 |

FOREIGN PATENT DOCUMENTS

| | | | |
|---|---|---|---|
| 2415584 | 9/1979 | France | 222/102 |
| 3904143 | 8/1990 | Germany | 222/102 |

*Primary Examiner*—Kevin P. Shaver
*Attorney, Agent, or Firm*—Jones, Tullar & Cooper

[57] ABSTRACT

A dispensing apparatus for automatically dispensing the paste-like content of a collapsible tube. The apparatus includes a housing having an outer door and an inner door hinged at the bottom to close a bottom opening and two pairs of vertical racks. A collapsible paste tube, installed inside the housing to hold a paste-like content. A dispensing unit consisting of two rollers, moved along the vertical racks to squeeze a fixed amount of the paste-like content out of the collapsible paste tube. A transmission gear unit driven to turn the rollers causes them to be moved along the vertical racks, and an induction type actuator controlled to detect the presence of a pick-up device for picking up the dispensed paste-like content from the collapsible paste tube by an electric eye and to turn the dispensing unit through the transmission gear unit by a first motor and to open the outer door by a second motor upon the detection of the presence of the pick-up device.

2 Claims, 12 Drawing Sheets

APPARATUS FOR DISPENSING THE CONTENT OF A COLLAPSIBLE PASTE TUBE

BACKGROUND OF THE INVENTION

The present invention relates to all apparatus for dispensing the paste-like content of a collapsible paste tube automatically by means of the control of an electric eye.

While squeezing the content of a collapsible paste tube, for example: a tube of toothpaste, it is difficult to control the output amount accurately. Although squeezing the content out of a collapsible paste tube is an easy job to an ordinary person, it is still a difficult job to those persons whose hands are injured or disabled. FIGS. 1 through 4 show a dispensing device for squeezing the content of a collapsible paste tube. The dispensing device comprises a casing 10, a pin 20, and a bottom shade 30. The casing 10 defines a V-groove 101 at the top, a slot 102 on the V-groove 101 at the bottom, a pin hole 103, and a through hole 104. The pin 20 inserts through the through hole 104 and the pin hole 103, having a finger lug 201 disposed at one end outside the casing 10. The pin 20 further comprises an elongated slot 202 longitudinally disposed at one side and a narrow groove 203 longitudinally disposed at an opposite side. The bottom shade 30 is covered on the casing 10 at the bottom. The closed bottom end 401 of the collapsible paste tube 40 is inserted through the V-groove 101 and the slot 102 into the slot 202 of the pin 20. When the finger lug 201 is turned to rotate the pin 20, the collapsible paste tube 40 is taken up by the pin 20 causing the paste-like content 402 squeezed out of the output end 403 of the collapsible paste tube 40. Because this structure of dispensing device is operated manually, it is still not easy to operate by those persons whose hands are injured or disabled.

SUMMARY OF THE INVENTION

The present invention has been accomplished under the circumstances in view. It is one object of the present invention to provide an apparatus which automatically dispenses the paste-like content of a collapsible paste tube. It is another object of the present invention to provide a collapsible paste tube dispensing apparatus which automatically dispenses a metered amount of the paste-like content out of the collapsible paste tube. It is still another object or the present invention to provide a collapsible paste tube dispensing apparatus which is convenient for use by those persons whose hands are injured or disabled. To achieve these objects, there is provided a dispensing apparatus comprising a having an outer door and an inner door hinged at the bottom to close a bottom opening and two pairs of vertical racks, a collapsible paste tube installed inside the housing to hold a paste-like content, a dispensing unit consisting of two rollers moved along the vertical racks to squeeze a fixed amount of the paste-like content out of the collapsible paste tube, a transmission gear unit driven to turn the rollers causing them moved along the vertical racks, and an induction type actuator controlled to detect the presence of a pick-up device for picking up the dispensed paste-like content from the collapsible paste tube by an electric eye and to turn the dispensing unit through the transmission gear unit by a first motor and to open the outer door by a second motor upon the detection of the presence of the pick-up device.

DETAILED DESCRIPTION OF THE PREFERRED EMBODIMENT

Referring to FIGS. 5, 6, 7, 11, and 13, the apparatus of the present invention is generally comprised of a housing 1, a dispensing unit 2, a transmission gear unit 3, and an induction type actuator 4.

Figure 1:
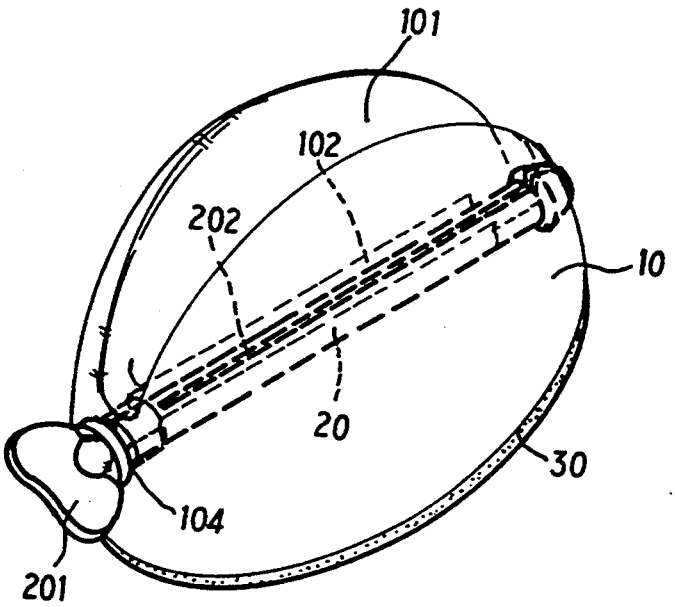
(PRIOR ART) FIG.1
FIG. 1 is a perspective view of a collapsible paste tube dispensing device according to the prior art.
Figure 2:
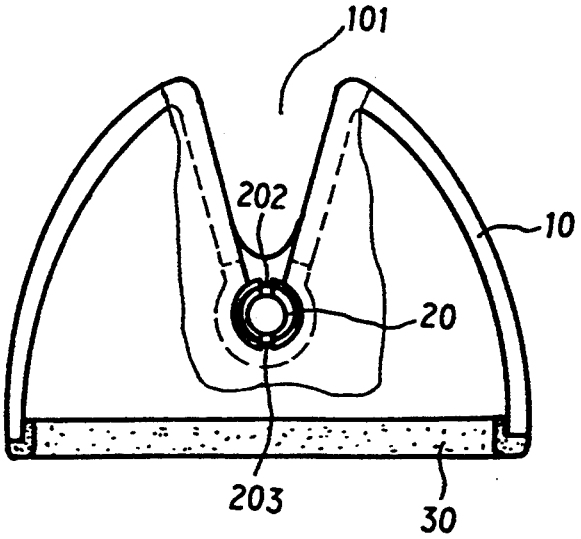
(PRIOR ART) FIG.2
FIG. 2 is an end view of the dispensing device shown in FIG. 1.
Figure 3:
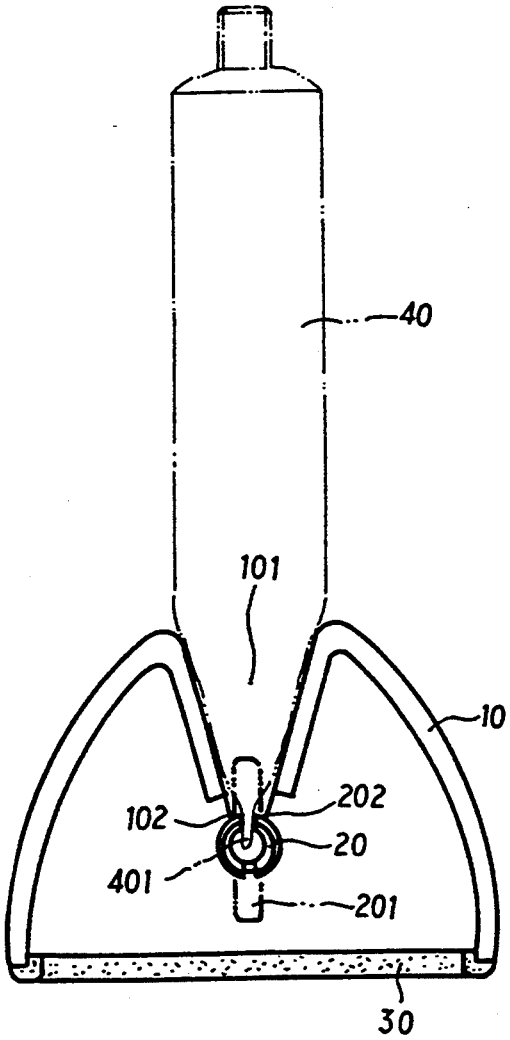
(PRIOR ART) FIG. 3
FIG. 3 is similar to FIG. 2 but showing the collapsible paste tube to be dispensed installed.
Figure 4:
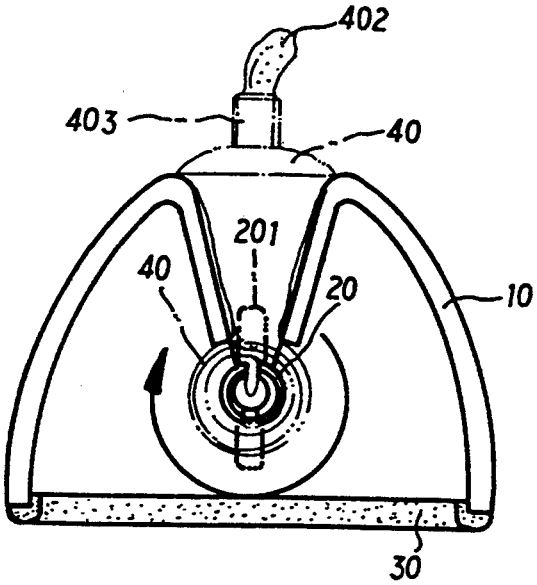
(PRIOR ART) FIG. 4
FIG. 4 is similar to FIG. 3 but showing the content or the collapsible paste tube dispensed.
Figure 5:
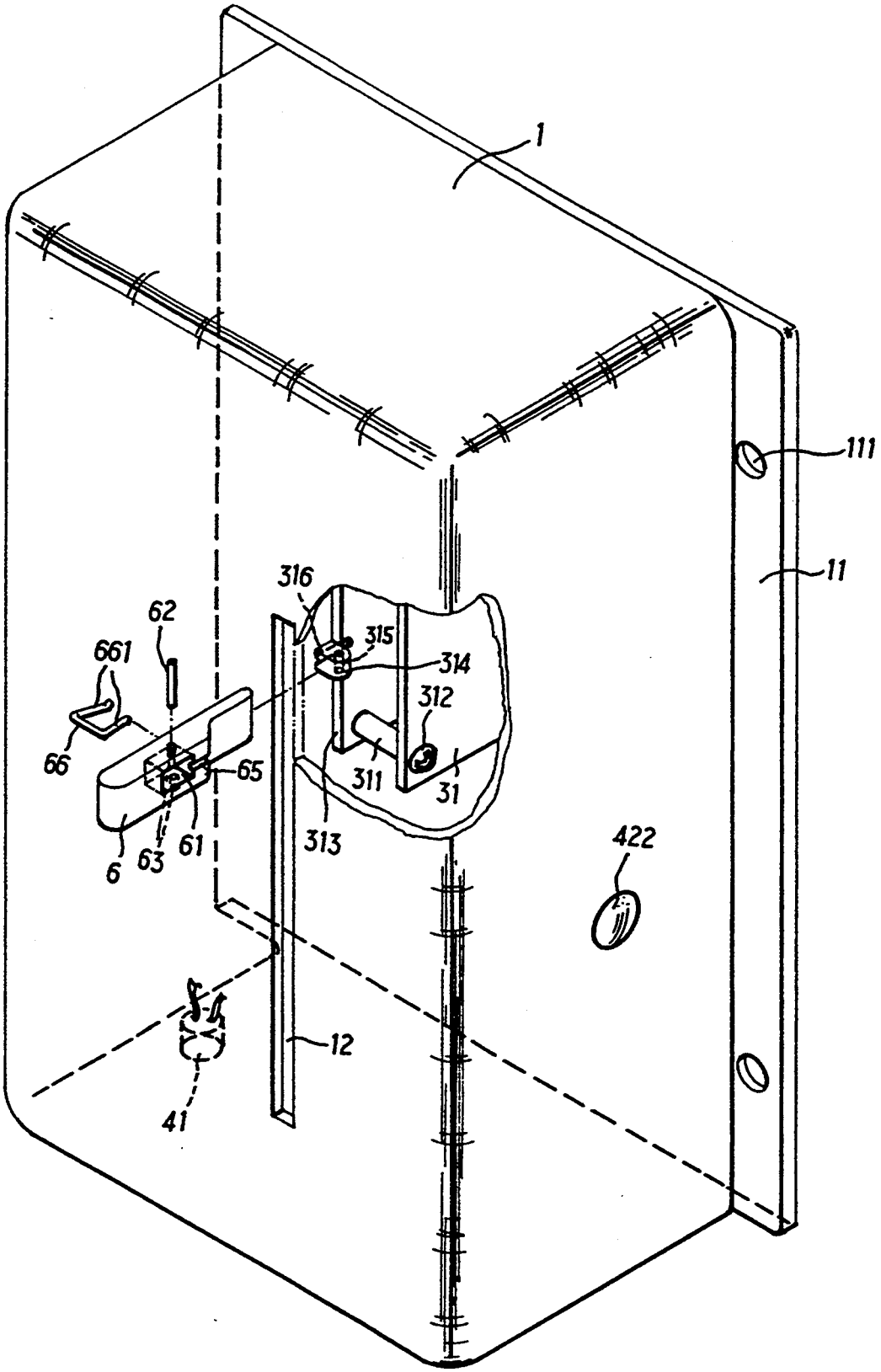
FIG. 5 is a perspective and partial cutaway of a collapsible paste tube dispensing apparatus according to the present invention.
Figure 6:
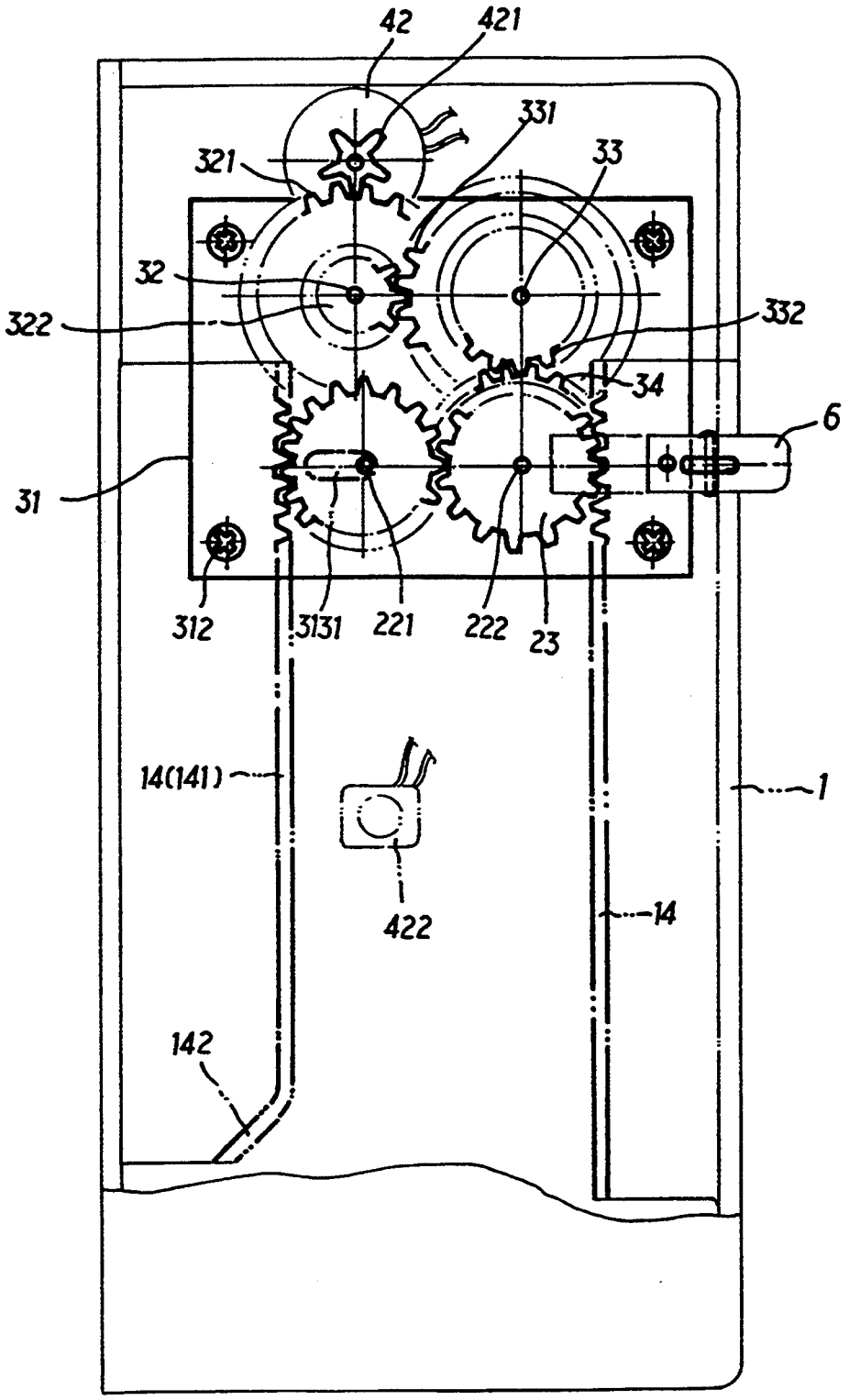
FIG. 6 is a side view in plain showing the internal structure of the apparatus shown in FIG. 5.

As illustrated in FIGS. 5, 6, 7, 9, and 10, the housing 1 comprises two extension walls 11 bilaterally extended from the back side thereof, a plurality of mounting holes 111 spaced on the extension walls 11 for allowing the housing 1 to be fastened to the wall inside the bathroom, an elongated slot 12 vertically disposed on the front side thereof at a suitable location, two pairs of parallel ribs 13 bilaterally disposed on the inside in the vertical direction and having a respective rack 14, a bottom opening (not shown) at the bottom side thereof, an outward-swinging outer door 15 hinged to the periphery of the bottom opening and constantly retained in the closed position by springs 151, and a swinging inner door 16 disposed adjacent to the outer door 15 and stopped in the closed position by a swivel pin 162 and having a through hole 161 at a suitable location, wherein the inner racks 141 have each a curved bottom section 142 (see FIG. 6).

Figure 7:
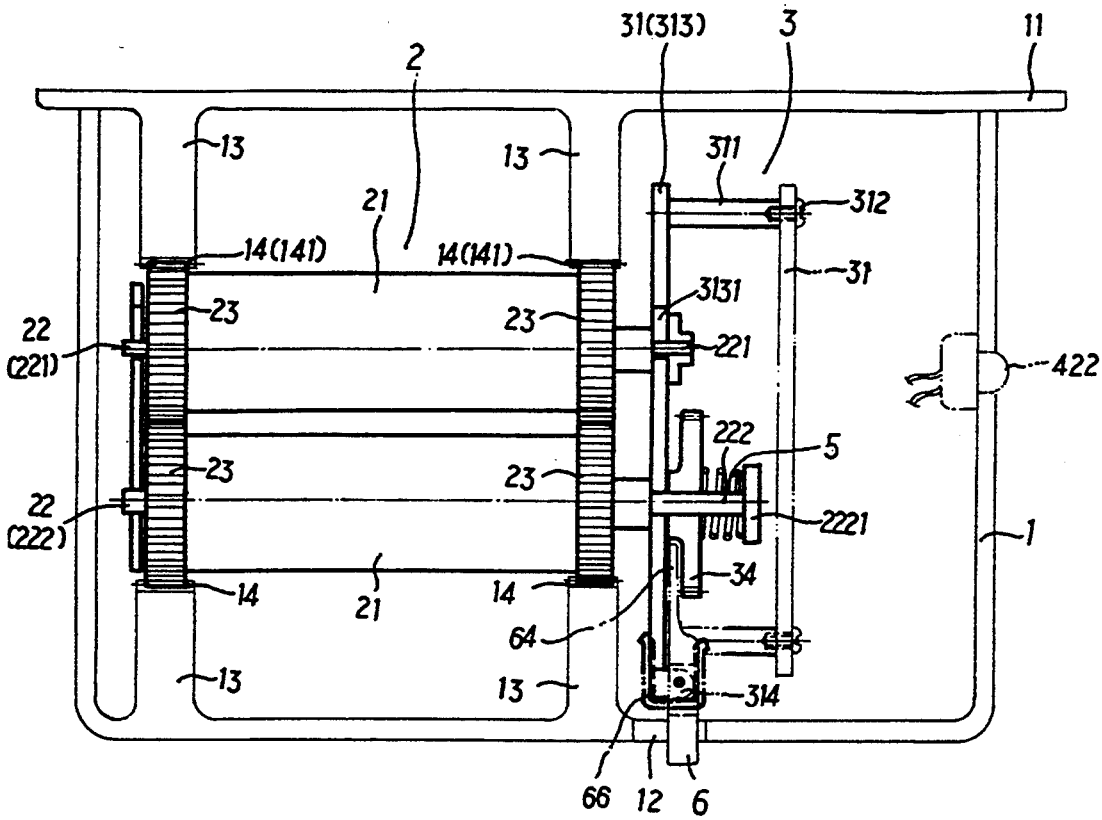
FIG. 7 is a top view of the dispensing unit for the apparatus shown in FIG. 5.
Figure 8:
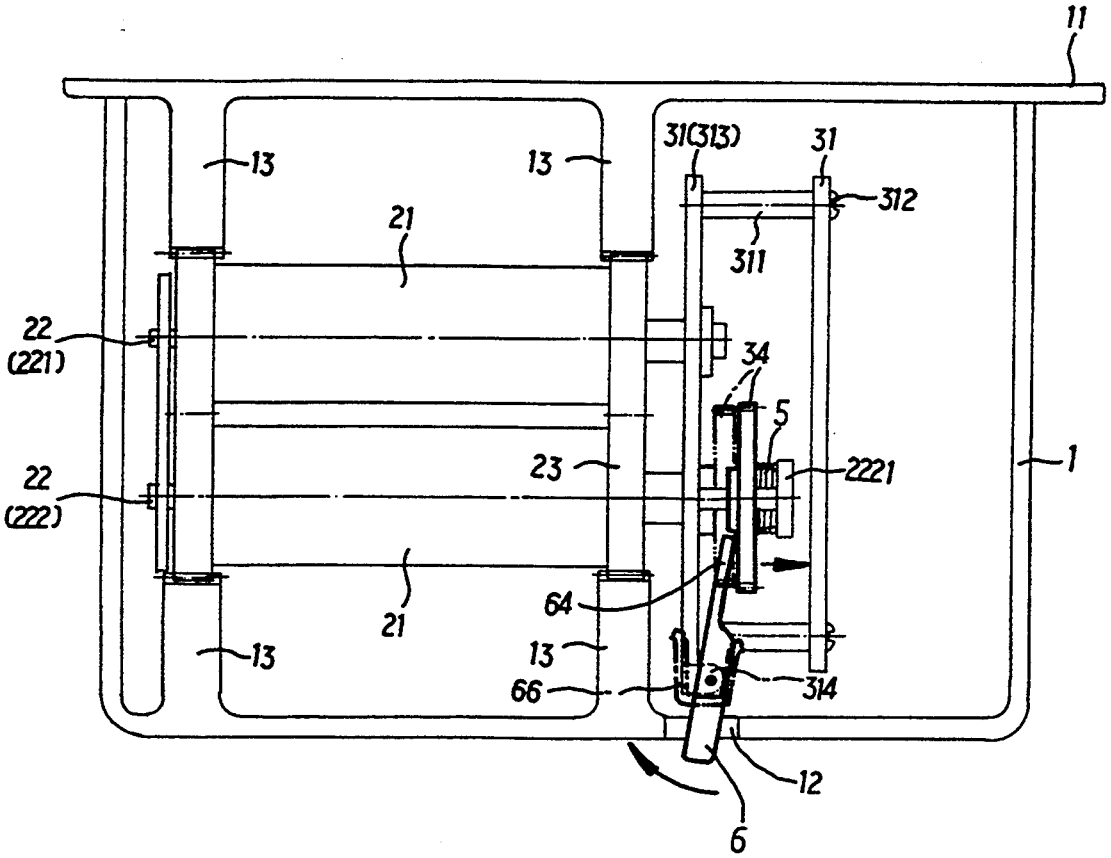
FIG. 8 is a plain view of FIG. 7 showing the lever pressed and the fifth gear disengaged from the fourth gear.
Figure 9:
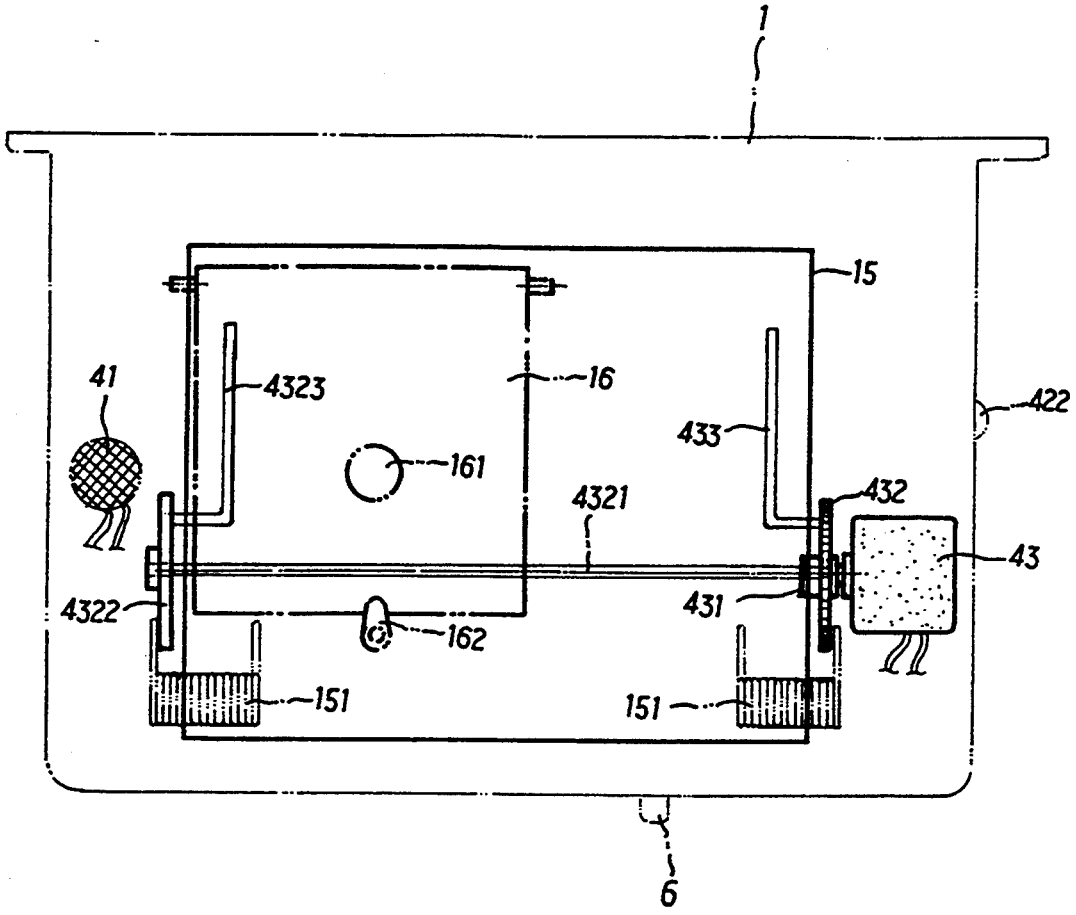
FIG. 9 is a bottom view in plain of the apparatus shown in FIG. 5.
Figure 10:
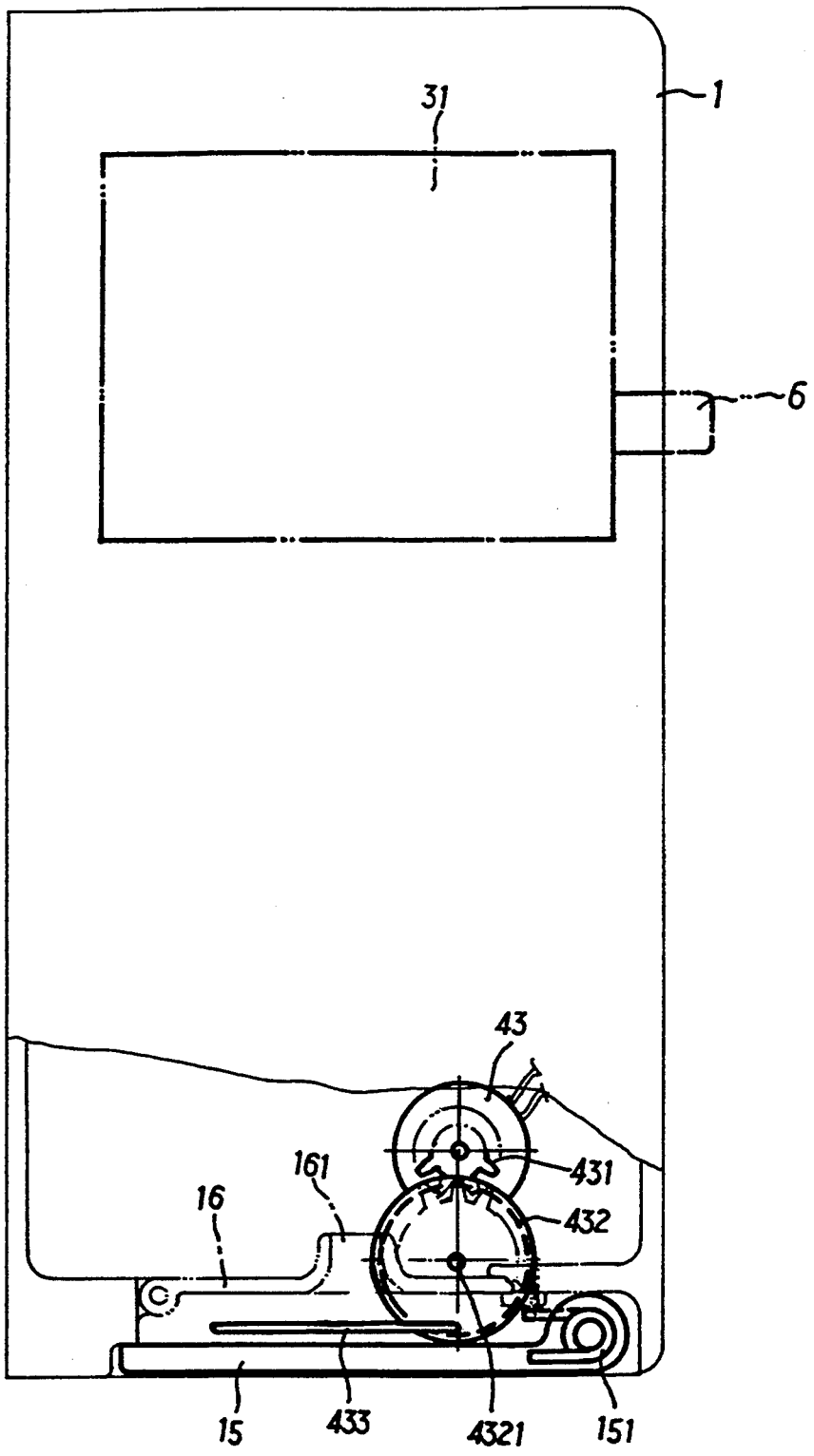
FIG. 10 is a side view in plain of the apparatus shown in FIG. 5, showing the relative positions of the second motor and the push rods and the outward-swinging outer door.
Figure 11:
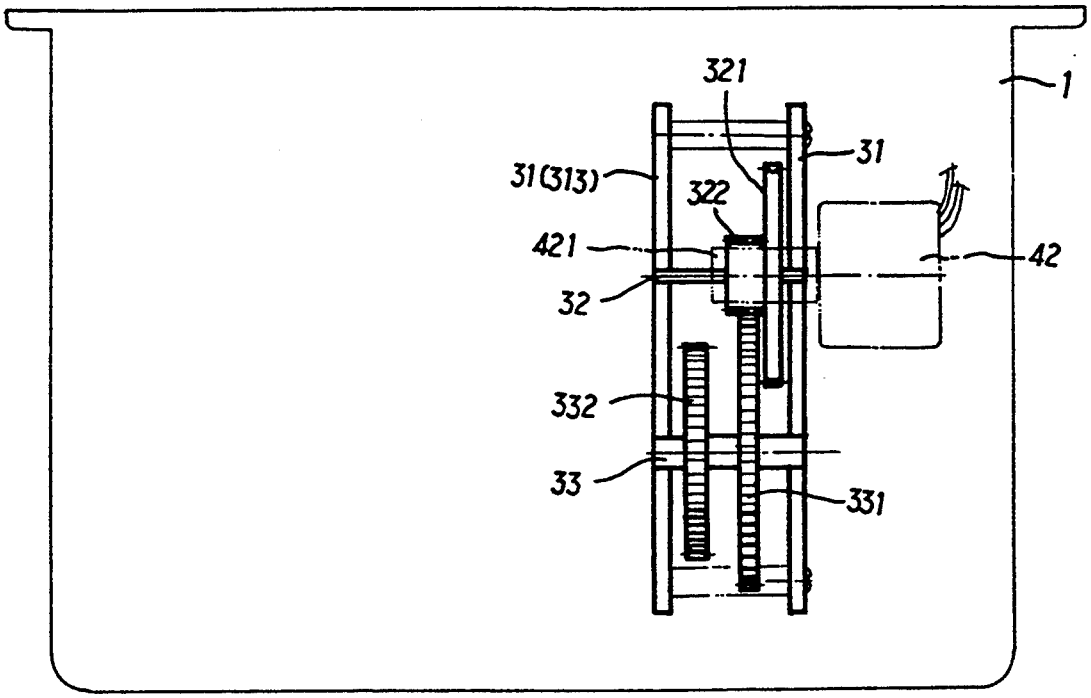
FIG. 11 is a top view of the transmission gear unit for the apparatus shown in FIG. 5.

As illustrated in FIGS. 6 and 7, the dispensing unit 2 comprises two rollers 21, two pair of meshed driven gears 23 respectively fixedly mounted around the two opposite round pins 22 of each roller 21 and respectively meshed with the racks 14. Therefore, turning the driven gears 23 causes the rollers 21 moved along the racks 14 upwards or downwards.

As illustrated in FIGS. 5, 6, 7, 8, and 11, the transmission gear unit 3 comprises two parallel frames 31 connected by spacers 311 and screw bolts 312. The left-sided frame 313 is fastened to the round pins 22 of the rollers 21 at one side. The inner-sided round pin 221 inserts through an elongated horizontal slot 3131 on the left-sided frame 313. A first gear shaft 32 and a second gear shaft 33 are respectively inserted through the parallel frames 31. A first gear 321 and a second gear 322 are fixedly mounted around the first gear shaft 32. A third gear 331 and a fourth gear 332 are fixedly mounted around the second gear shaft 33. The third gear 331 is meshed with the second gear 332 (see FIGS. 6 and 10). The outer-sided round pin 222 which inserts through a hole (not shown) on the left-sided frame 313 is mounted with a fifth gear 34 meshed with the fourth gear 332 (see FIG. 6). When the first gear 321 is rotated, the power is transmitted in proper order through the second gear 322, the third gear 331, the fourth gear 332, the fifth gear 34, and the driven gear 23, causing the rollers 21 of the dispensing unit 2 moved along the racks 14 (See FIG. 6). As the rollers 21 are synchronously moved along the racks 14, the transmission gear unit 3 is simultaneously moved in the same direction. Furthermore, a spring element 5 is mounted around the outer-sided round pin 222 and stopped between the fifth gear 34 and the head 2221 of the outer-sided round pin 222 (see FIG. 7). The left-sided frame 313 comprises a projecting block 314 disposed adjacent to the fifth gear 34, having a vertical through hole 315 at a suitable location and a horizontal groove 316 at one side. A lever 6 is connected to the projecting block 314. The lever 6 comprises an opening 61, which receives the projecting block 314, and a through hole 63. By fitting a pivot pin 62 into the through hole 63 on the lever 6 and the through hole 315 on the projecting block 314, the lever 6 is fastened to the projecting block 314. The lever 6 extends out of the housing 1 through the elongated slot 12, having a front end 64 inserted into the space between the left-sided frame 313 and the fifth gear 34 (see FIG. 8). The lever 6 further comprises a groove 65 at one side. There is provided a spring member 66 inserted through the opening 61 of the lever 6, having two opposite ends 661 respectively fastened to the groove 65 on the lever 6 and the groove 316 on the projecting block 314. Therefore, the spring member 66 automatically returns the lever 6 to its former position each time the lever 6 is moved.

As illustrated in FIGS. 5, 6, 9, and 13, the induction type actuator 4 comprises an electric eye 41, a first motor 42, and a second motor 43. The electric eye 41 is mounted on the housing 1 at the bottom (see FIGS. 5 and 9) and connected to the first motor 42 and the second motor 43 respectively. The first motor 42 has a drive gear 421 fixedly coupled to the output shaft (not shown) thereof and meshed with the first gear 321 of the transmission gear unit 3. When the electric eye 41 detects a signal, the first motor 42 is triggered to turn the drive gear 421 clockwise for a predetermined length of time. When the drive gear 421 is rotated, the gears 321, 322, 331, 332 and 34 are moved, causing the rollers 21 moved along the racks 14 (see FIG. 13). ,When the rollers 21 are moved along the racks 14, the dispensing unit 2 and the transmission gear unit 3 are simultaneously moved in the same direction. The first motor 42 is further connected to a return control switch 422. When the return control switch 422 is pressed, the first motor 42 is driven to turn the drive gear 421 in the reversed direction, causing the dispensing unit 2 and the transmission gear unit 3 moved back to their former positions. The second motor 43 is mounted inside the housing 1 at the bottom, having a drive gear 431 fixedly mounted on the output shaft thereof and meshed with a rotary wheel 432. The rotary wheel 432 comprises a first push rod 433 at the bottom, an elongated wheel shaft 4321 at one side, a side board 4322 mounted on the end of the elongated wheel shaft 4321, and a second push rod 4323 extended from the side board 4322. Each time the electric eye 41 detects a signal, the second motor 43 is driven to turn the drive gear 431 back and forth in one cycle. During the forward stroke of the drive gear 431, the first and second push rods 433 and 4323 are moved to push open the outward-swinging outer door 15. When the first and second push rods 433 and 4323 are turned back during the backward stroke of the drive gear 431, the springs 151 automatically pull the outward-swinging outer door 15 back to the closed position (see FIGS. 9, 13, and 14).

Figure 12:
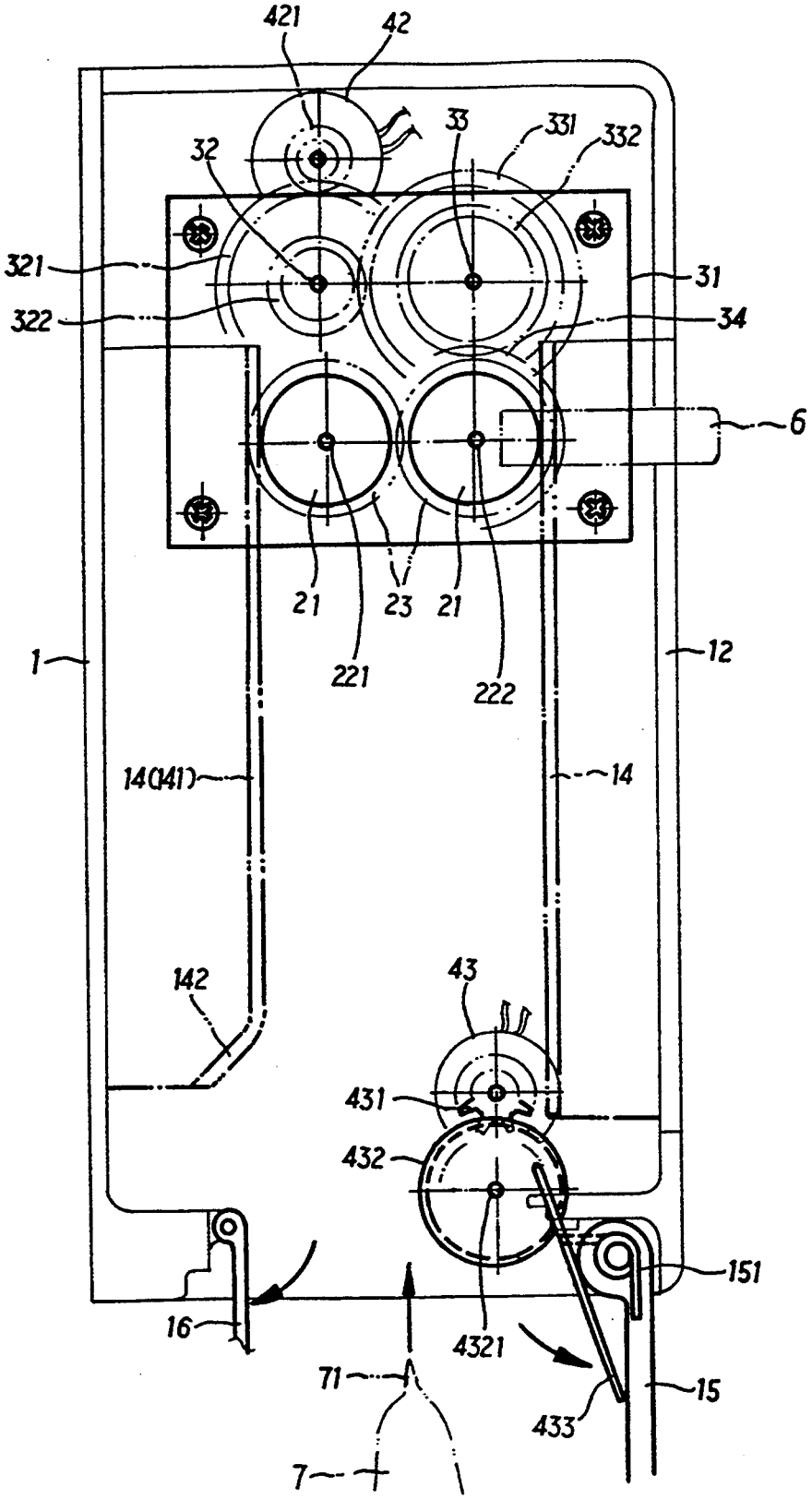
FIG. 12 is another side view in plain of the apparatus shown in FIG. 5, showing the outward-swinging outer door opened.
Figure 13:
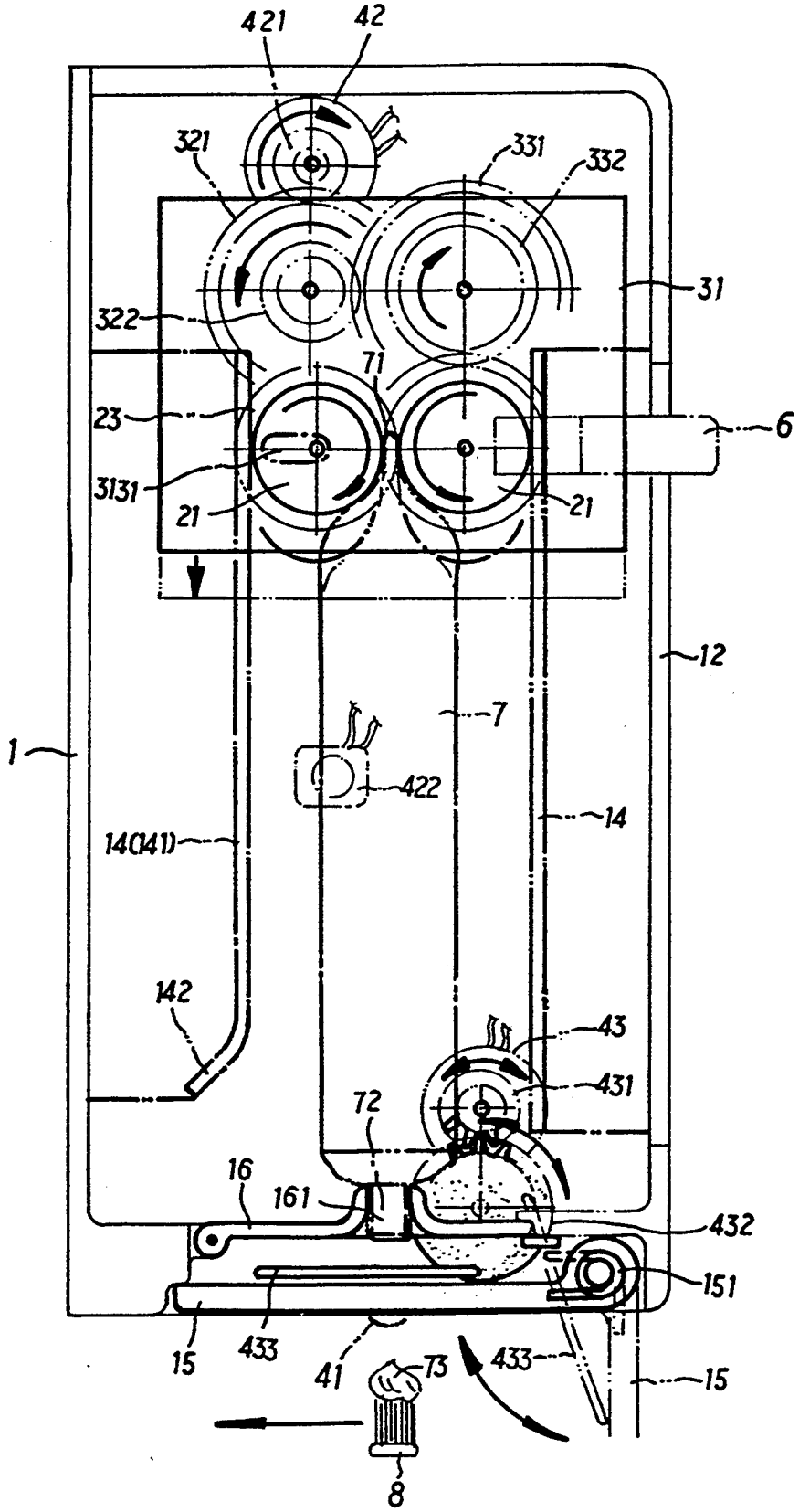
FIG. 13 is still another side view in plain of the apparatus shown ill FIG. 5, showing the induction type actuator operated.

The operation of the present invention will now be described hereinafter. The outer door 15 is pulled outwards and then the inner door 16 is opened (see FIG. 12). Then, the lever 6 is turned to move the fifth gear 34 rightward by the front end 64 of the lever 6 (see FIG. 8), causing the fifth gear 34 disengaged from the fourth gear 332, and therefore the rollers 21 of the dispensing unit are released from the transmission gear unit 3. Then, the closed bottom end 71 of the collapsible tube 7 (toothpaste tube or the like) to be dispensed is inserted into the gap between the rollers 21 from the bottom. When the collapsible tube 7 is installed, the lever 6 is released, and therefore the fifth gear 34 is pushed back by the spring to engage with the fourth gear 332 again. When the inner door 16 is closed, the output end 72 of the collapsible tube 7 is supported within the through hole 161. When the outer door 15 is closed, the installation of the collapsible tube 7 is done. When the electric eye 41 is triggered by an object, for example: a toothbrush 8, the first and second motors 42 and 43 are simultaneously turned on. When the first motor 42 is turned on, the drive gear 421 is turned clockwise for a predetermined length of time, causing the rollers 21 of the dispensing unit 2 moved downwards along the track 14 at a certain distance. As the rollers 21 are moved downwards, a certain amount of the content 73 (for example: toothpaste) of the collapsible tube 7 is drawn out. At the same time, the outward-swinging outer door 15 is pushed open by the push rods 433 and 4323 such that the user can pick up the dispensed content 73 from the output end 72 of the collapsible tube 7. After the pick-up of the dispensed content, the push rods 433 and 4323 are turned back, causing the outward-swinging outer door 15 pulled back to the closed position by the springs 151.

Figure 14:
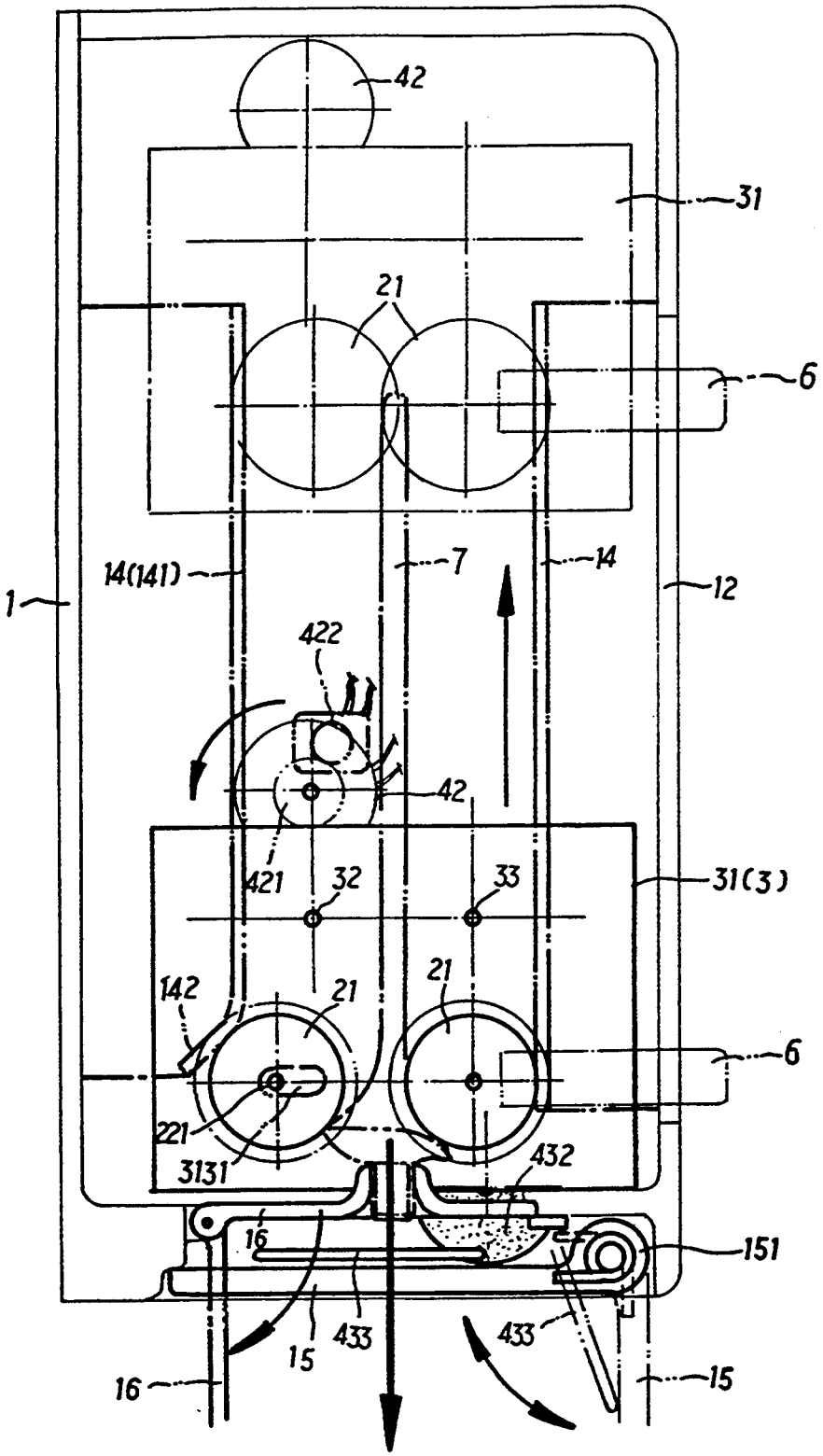
FIG. 14 is similar to FIG. 13 but showing the rollers moved to the curved bottom sections of the racks.

Referring to FIG. 14, when the collapsible tube 7 is almost used up, the dispensing unit 2 is moved to the curved bottom sections 142 of the inner racks 141, therefore the rollers 21 are moved apart to extend the gap therebetween, and at the same time, the inner-sided round pin 221 is moved inwards along the elongated horizontal slot 3131. The user can then open the outer and inner doors 15 and 16 to take out the empty collapsible tube 7, and then press the return control switch 422 to turn on the first motor 42 in the reversed direction causing the dispensing unit 2 and the transmission gear unit 3 moved to their former positions.

What is claimed is:

1. A dispensing apparatus for automatically dispensing the paste-like content of a collapsible tube, the apparatus comprising:

a housing having an elongated slot vertically disposed on a front wall thereof, two opposing pairs of vertical racks, a bottom opening on a bottom wall thereof, an outward-swinging outer door retained by springs to close said bottom opening, and a swinging inner door stopped in a closed position inside said bottom opening by a swivel pin, said swinging inner door having a through hole, said opposing pairs of vertical racks including one inner pair of vertical racks having each a curved bottom section;

a collapsible paste tube installed inside said housing to hold a paste-like content;

a dispensing unit mounted within said housing and moved to squeeze said collapsible paste tube causing said collapsible paste tube to send a predetermined amount of the paste-like content out of said housing through the through hole on said swinging inner door, said dispensing unit comprising two rollers having each two round pins longitudinally aligned at two opposite ends and two driven gears respectively fixedly mounted around the round pins and respectively meshed between said opposing pairs of vertical racks;

a transmission gear unit mounted on the round pins of said rollers at one side, said transmission gear unit comprising two parallel frames connected by spacers and screw bolts, a first gear shaft and a second gear shafts respectively inserted through holes on the parallel frames, a first gear and a second gear fixedly mounted around said first gear shaft, a third gear and a fourth gear fixedly mounted around said second gear shaft, said third gear being meshed with said second gear, a fifth gear fixedly mounted around one of said round pins at an outer side of one roller and supported by a spring member to mesh with said fourth gear;

a lever pivotally fastened to said transmission gear unit and retained in place by a spring member, said lever having one end extended out of the elongated slot on the front wall of said housing and moved to disengage said fifth gear from said fourth gear;

an induction type actuator controlled by an electric eye to detect the presence of a pick-up device for picking up the dispensed paste-like content from said collapsible paste tube and to turn said dispensing unit through said transmission gear unit causing said dispensing unit to squeeze a predetermined amount of the paste-like content out of said collapsible paste tube, said induction type actuator comprising a first motor controlled by said electric eye to rotate to said first gear in one direction at a predetermined distance, a return control switch controlled to turn said first motor reversely at a predetermined distance, a second motor controlled by said electric eye to turn a rotary wheel back and forth in one cycle causing said rotary wheel to open said outward-swinging outer door by push rods thereof; and wherein when said pick-up device is detected by said electric eye, said first motor is triggered by said electric eye to move said rollers along said opposing pairs of opposite racks at a predetermined distance in squeezing a predetermined amount of the paste-like content out of said collapsible paste tube, and said second motor is simultaneously triggered by said electric eye to open said outward-swinging outer door for permitting the dispensed paste-like content to be picked up by said pick-up device; and wherein when said rollers are moved to the curved bottom sections of said vertical racks, said rollers are spaced from said collapsible paste tube.

2. The dispensing apparatus of claim 1 wherein said lever comprises an opening, which receives a projecting block on said transmission gear unit, and a through hole, a pivot pin inserted through the through hole on said lever and a through hole on said projecting block, a groove at one side, a spring member having one end fastened to the groove on said lever and an opposite end fastened to a groove on said projecting block, the spring member of said lever automatically returning said lever to its former position each time said lever is pressed.

* * * * *